US007184005B2

(12) United States Patent
Kobayashi et al.

(10) Patent No.: US 7,184,005 B2
(45) Date of Patent: Feb. 27, 2007

(54) IMAGE DISPLAY APPARATUS

(75) Inventors: Yoshinao Kobayashi, Shiga (JP); Shinya Ono, Shiga (JP)

(73) Assignees: Kyocera Corporation, Kyoto (JP); Chi Mei Optoelectronics Corp., Tainan Science-Based Industrial Park (TW)

( * ) Notice: Subject to any disclaimer, the term of this patent is extended or adjusted under 35 U.S.C. 154(b) by 0 days.

(21) Appl. No.: 10/859,161

(22) Filed: Jun. 3, 2004

(65) Prior Publication Data

US 2005/0017930 A1 Jan. 27, 2005

(30) Foreign Application Priority Data

Jun. 5, 2003 (JP) ..... 2003-161329

(51) Int. Cl.
*G09G 3/30* (2006.01)

(52) U.S. Cl. ..... 345/76; 315/169.3

(58) Field of Classification Search ..... 315/169.3, 315/169.4; 345/76, 77, 82, 84, 214
See application file for complete search history.

(56) References Cited

U.S. PATENT DOCUMENTS 5,714,968 A * 2/1998 Ikeda ..... 345/76
5,990,629 A * 11/1999 Yamada et al. ..... 315/169.3
6,731,276 B1 * 5/2004 Ishizuka ..... 345/214
6,774,878 B2 * 8/2004 Yoshida et al. ..... 315/169.3

FOREIGN PATENT DOCUMENTS

JP 08-234683 A 9/1996

* cited by examiner

*Primary Examiner*—Tuyet Vo
*Assistant Examiner*—Ephrem Alemu
(74) *Attorney, Agent, or Firm*—Birch, Stewart, Kolasch & Birch, LLP

(57) ABSTRACT

An image display apparatus includes a current-controlled light emitting diode emitting light with brightness corresponding to a current flowing therethrough; a wiring structure electrically connected to the current-controlled light emitting diode; and a potential controller controlling a potential of the wiring structure. The image display apparatus also includes a potential change assisting unit controlling electric conductivity between the potential controller and the wiring structure, to change a potential of the wiring structure after a light emitting phase.

19 Claims, 4 Drawing Sheets

IMAGE DISPLAY APPARATUS

This Non-provisional application claims priority under 35 U.S.C. 119(*a*) on patent application Ser. No(s). 2003-161329 filed in Japan on Jun. 5, 2003, the entire contents of which are hereby incorporated by reference.

BACKGROUND OF THE INVENTION

1) Field of the Invention

The present invention relates to an image display apparatus including a current-controlled light emitting diode that emits light based on electric current supplied by a current source, and more specifically, relates to an image display apparatus having a configuration such that the potential of a wiring structure connected to the current source is changed.

2) Description of the Related Art

An organic light emitting diode (hereinafter, "organic LED") display apparatus using an organic electroluminescent (EL) device that emits light itself, is most suitable for making the apparatus thin, since it does not require a backlight, which is required in a liquid crystal display apparatus, and does not have any limitation in the angle of visibility. Therefore, practical use thereof is expected as a next-generation display apparatus.

As the image display apparatus using the organic LEDs, a simple (passive) matrix type and an active matrix type are known as the drive system. The former has a simple configuration, but has a problem in that realization of a large-scale and highly delicate display is difficult. Therefore, development of the active matrix type display apparatus has been recently performed, which controls-the current flowing through light emitting diodes in pixels, by an active element provided in the pixel, for example, a thin film transistor.

FIG. 5 depicts a pixel circuit in the conventional active matrix type organic LED display apparatus. The pixel circuit according to the conventional apparatus includes an organic LED 105, being a current-controlled light emitting diode, a thin film transistor 104 whose drain electrode is connected to the negative electrode of the organic LED 105 and whose source electrode is connected to a wiring structure 108, and serving as a driver element, a capacitor 103 connected between a gate electrode of the thin film transistor 104 and the wiring structure 108, and a thin film transistor 102 whose drain electrode is connected to the gate electrode of the thin film transistor 104, source electrode to a signal line 101, and the gate electrode to a scan line 106, respectively, and serving as a switching element. The organic LED display apparatus has a current source 107 for supplying electric current flowing through the organic LED 105, and the current source 107 has such a structure that it is electrically connected to the thin film transistor 104 via the wiring structure 108.

In the pixel circuit shown in FIG. 5, a voltage corresponding to the display brightness is supplied from the data line 101 to the capacitor 103 via the thin film transistor 102. Since the capacitor 103 is arranged between the gate and the source of the thin film transistor 104, the gate to source voltage of the thin film transistor 104 becomes equal to the voltage stored in the capacitor 103, and a predetermined channel is formed between the source and the drain based on the gate to source voltage. The current source 107 supplies the electric current corresponding to the mobility realized by the channel of the thin film transistor. 104, so that the current flows to between the source and the drain of the thin film transistor 104 and the organic LED 105 serially connected to the thin film transistor 104, and the organic LED 105 emits light with desired brightness (See Japanese Patent Application Laid-Open No. H8-234683 for example).

An image display apparatus, in which a compensation circuit that compensates threshold voltage fluctuations in the thin film transistor 104 is incorporated, is also known. It is preferable to use amorphous silicon for the channel forming area of the thin film transistor 104, in order to suppress fluctuations in the IV characteristics of the driver element for each display pixel. When the amorphous silicon is used, however, it is known that the threshold voltage fluctuates due to longtime use, and it is desired to compensate the threshold voltage fluctuation from a viewpoint of enabling high quality image display.

There are various configurations of the compensation circuit, and as one example, a configuration in which a thin film transistor for voltage compensation is arranged, and voltage compensation is performed by combining the operation of such a thin film transistor and potential changes of the wiring structure 108 is known. When such a compensation circuit is arranged, the current source 107 not only performs a function of supplying electric current to the organic LED 105, but also operates for changing the potential of the wiring structure 108 by supplying an electric charge to the wiring structure 108.

However, the image display apparatus using the organic LEDs has various problems due to the structure in which the current is supplied to the organic LEDs at the time of image display. In the actual image display apparatus, it is necessary to increase the physical length of the wiring structure 108 with respect to the display pixel arranged away from. the current source 107, and it is necessary to increase the sectional area of the wiring structure 108, in order to suppress an increase in the electrical resistivity with an increase in the physical length.

On the other hand, due to the increase in the sectional area of the wiring structure 108, the area in which the wiring structure 108 overlaps on another wiring structure, for example, the scan line 106 increases, thereby increasing the parasitic capacitance of the wiring structure 108. The problem due to the parasitic capacitance is elicited in the configuration in which the potential of the wiring structure 108 is changed, for example, when the compensation circuit is incorporated in the image display apparatus.

For example, when the threshold voltage fluctuation of the thin film transistor 104 is compensated by incorporating the compensation circuit, it is necessary to change the potential of the wiring structure 108 at the time of operation. In order to change the potential, it is necessary to supply electric charges with respect to the parasitic capacitance. Therefore, when the parasitic capacitance of the wiring structure 108 increases, the time required for changing the potential increases corresponding to the increased amount of the parasitic capacitance.

An increase in the time required for the potential change means that the time required for voltage compensation also increases, leading to restrictions on achieving high definition or a large screen of the image display apparatus. That is, while compensation for the threshold voltage fluctuation is required for all driver elements provided for the respective pixels, the time allowed for performing the voltage compensation with respect to all driver elements is limited to a certain value. Therefore, in order to increase the number of pixels in view of realizing high definition or a large screen of the image display apparatus, it is essential to reduce the time required for voltage compensation with respect to the individual driver element.

Power consumption of the current source 107 required at the time of changing the potential of the wiring structure 108 is another problem. Since it is normal that the compensation circuit operates for each frame, the current source 107 needs to supply the current with respect to the wiring structure 108 for each frame separately from the light emitting phase, in order to change the potential of the wiring structure 108. Since certain electrical resistivity and parasitic capacitance exist in the wiring structure 108, it cannot be avoided that a certain amount of power consumption occurs in the current source 107, with a potential change of the wiring structure 108. When such power consumption is small, there is no problem, but actually, unignorable amount of power consumption is required, and it is concerned that the heat generated from the current source 107 may adversely affect the image display apparatus and the current source 107 itself.

SUMMARY OF THE INVENTION

It is an object of the present invention to at least solve the problems in the conventional technology.

An image display apparatus according to one aspect of the present invention includes a current-controlled light emitting diode emitting light with brightness corresponding to a current flowing therethrough; a wiring structure electrically connected to the current-controlled light emitting diode; and a potential controller controlling a potential of the wiring structure. The image display apparatus also includes a potential change assisting unit controlling electric conductivity between the potential controller and the wiring structure, to change a potential of the wiring structure after a light emitting phase.

The other objects, features, and advantages of the present invention are specifically set forth in or will become apparent from the following detailed description of the invention when read in conjunction with the accompanying drawings.

DETAILED DESCRIPTION

Exemplary embodiments of an image display apparatus according to the present invention will be explained below, with reference to the drawings. The drawings are only schematic, and are different from the actual ones. It is a matter of course that parts having different relations and ratios in mutual dimensions are included in the accompanying drawings.

The image display apparatus according to the embodiment includes wiring structures electrically connected to organic LEDs serving as current-controlled light emitting diodes. When the potential of the wiring structure is changed, the wiring structure is insulated from others so as to be in a floating state, and the current flowing in the organic LED is made to flow therein, so that the potential of the wiring structure is changed due to the inflow of the current.

Figure 1:
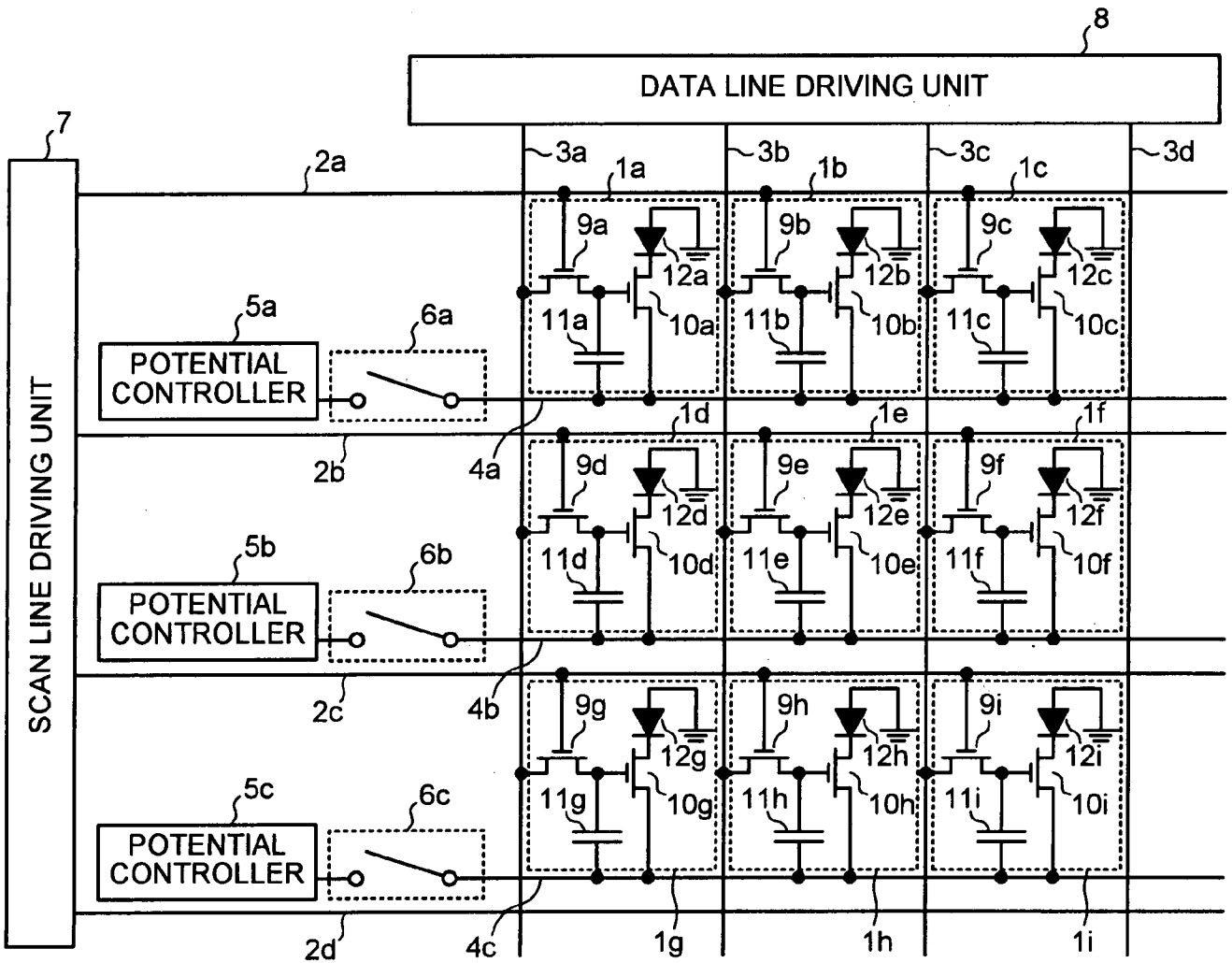
FIG. 1 depicts the configuration of an image display apparatus according to an embodiment.

FIG. 1 is a circuit diagram of the configuration of the image display apparatus according to the embodiment. As shown in FIG. 1, the image display apparatus includes pixel circuits 1*a* to 1*i* (hereinafter, any one of them is referred to as "pixel circuit 1") arranged in a plurality of numbers, scan lines 2*a* to 2*d* (hereinafter, any one of them is referred to as "scan line 2") and data lines 3*a* to 3*d* (hereinafter, any one of them is referred to as "data line 3") for supplying a predetermined potential to the pixel circuits 1, wiring structures 4*a* to 4*c* (hereinafter, any one of them is referred to as "wiring structure 4") for supplying electric current to current-controlled light emitting diodes arranged within the pixel circuits 1, and potential controllers 5*a* to 5*c* (hereinafter, any one of them is referred to as "potential controller 5") that control the potential of the wiring structures 4. The image display apparatus according to the embodiment further includes switching units 6*a* to 6*c* (hereinafter, any one of them is referred to as "switching unit 6") arranged between the wiring structures 4 and the potential controllers 5, which control the electrical connection between the wiring structures 4 and the potential controllers 5, a scan line driving circuit 7 electrically connected to the scan lines 2, and a data line driving circuit 8 connected to the data lines 3.

The pixel circuits 1 are arranged in a matrix corresponding to the display pixels, and the individual pixel circuit 1 displays light of a predetermined brightness, respectively, to display an image as a whole of the image display apparatus. Specifically, the individual pixel circuit 1 includes a thin film transistor 9 (i.e., any one of thin film transistors 9*a* to 9*i*) serving as a switching element having a gate electrode connected to the scan line 2, with one of the source and the drain electrodes connected to the data line 3, and a thin film transistor 10 (i.e., any one of thin film transistors 10*a* to 10*i*) serving as a driver element and having a gate electrode connected to the other of the source and drain electrodes of the thin film transistor 9. The pixel circuit 1 further includes an organic LED 12 (i.e., any one of LEDs 12*a* to 12*i*) serving as a current-controlled light emitting diode, with the cathode side connected to one of the source and the drain electrodes of the thin film transistor 10, and the anode side grounded, and a capacitor 11 (i.e., any one of capacitors 11*a* to 11*i*) arranged between the gate and the source of the thin film transistor 10, for holding the voltage supplied from the data line 3.

The organic LED 12 servings as the current-controlled light emitting diode that emits light with a brightness corresponding to the injected current value, and specifically, has a configuration in which the anode layer, the light emitting layer, and the cathode layer are sequentially laminated. The light emitting layer is for radiative recombination of the electrons injected from the cathode layer side and holes injected from the anode layer side. Specifically, the light emitting layer is formed of an organic material, such as phthalocyanine, trisaluminum complex, benzoquinolinolate, and beryllium complex, and has a structure of being bonded with impurities as required. The organic LED 12 may have such a structure in which a hole transporting layer is provided on the anode side with respect to the light emitting layer, and an electron transporting layer is provided on the cathode side with respect to the light emitting layer.

The scan line 2 is for controlling the driven state of the thin film transistor 9 serving as the switching element.

Specifically, the scan lines 2 are connected to a scan line driving circuit 7, and the scan line driving circuit 7 has a function of applying a predetermined voltage so that a selected thin film transistor 9 becomes ON state, matched with the timing of voltage write.

The data lines 3 are for supplying a write voltage to the capacitor 11 via the thin film transistor 9 serving as the switching element. Specifically, the data lines 3 are connected to a data line driving circuit 8, and the data line driving circuit 8 supplies a voltage corresponding to the light emitting brightness of the organic LEDs 12, determined based on an image signal input from outside to the capacitor 11.

The wiring structure 4 is for connecting the other of the source and the drain electrodes of the thin film transistor 10 to the potential controllers 5. Specifically, the wiring structure 4 is connected to the other of the source and the drain electrodes of the thin film transistor 10, and to the switching unit 6 with respect to the potential controllers 5. In the embodiment, as shown in FIG. 1, the wiring structure 4 is connected to the thin film transistors 10 included in the pixel circuits 1 belonging to the same line.

The switching unit 6 controls the electrical conduction between the potential controllers 5 and the wiring structure 4. Specifically, the switching unit 6 is, for example, formed of a thin film transistor and controlled so as to be ON state or OFF state by controlling the voltage applied to between the gate and the source, and electrically connects or insulates between the wiring structure 4 and the potential controller 5. In the embodiment, the switching unit 6 serves as a potential change assisting unit to reduce the load on the potential controller 5 at the time of changing the potential of the wiring structure 4.

The operation of the image display apparatus according to the embodiment will be explained next. The image display apparatus according to the embodiment sequentially performs a light emitting phase of allowing the organic LED 12 to emit light with desired brightness, and a potential changing phase of changing the potential of the wiring structure 4. The light emitting phase will be briefly explained first, and then the potential changing phase will be explained.

Figure 2A:
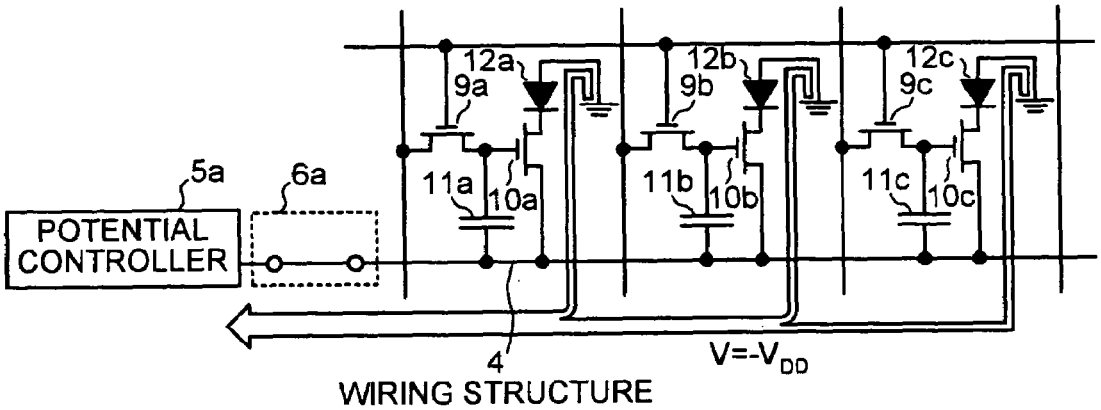
FIGS. 2A and 2B are schematic diagrams of the operation of the image display apparatus according to the embodiment.

FIG. 2A is a schematic diagram for explaining the light emitting phase. At the light emitting phase, a predetermined pixel circuit 1 is selected to supply a predetermined voltage from the scan line 2 to the gate electrode of the thin film transistor 9 arranged within the selected pixel circuit 1, to set the thin film transistor 9 to the ON state. On the other hand, the data line driving circuit 8 provides the data line 3 with a voltage corresponding to the brightness, with which the organic LED 12 arranged in the pixel circuit 1 emits light, and such a voltage is written in the capacitor 11 via the thin film transistor 9 in the ON state. Since the capacitor 11 is arranged between the gate and the source of the thin film transistor 10, the voltage written in the capacitor 11 directly becomes the gate to source voltage of the thin film transistor 10.

On the other hand, as shown in FIG. 2A, at the light emitting phase, the switching unit 6 is maintained in the ON state, so that the potential controller 5 and the wiring structure 4 are maintained in the electrically connected state. The potential controller 5 controls so that the potential of the wiring structure 4 has a sufficiently low value, as compared with the potential on the anode side of the organic LED 12, at the light emitting phase. In the embodiment, the anode side of the organic LED 12 is grounded, while the potential of the wiring structure 4 is maintained at $-V_{DD}$ ($V_{DD}>0$), being a negative potential.

Since the wiring structure 4 is maintained at the negative potential, a voltage is applied to the organic LED 12 in the forward direction, while the thin film transistor 10 is maintained in the ON state. Therefore, the current flows to the organic LED 12 in the direction shown by arrow in FIG. 2A, that is, in the forward direction, and the flowing current value is controlled by the thin film transistor 10, and hence the organic LED 12 emits light with predetermined brightness.

At the light emitting phase, since the switching unit 6 is maintained in the ON state, the potential of the wiring structure 4 is maintained at a certain value by the potential controller 5, and as a result, the voltage between the electrodes of the capacitor 11, one electrode of which is connected to the wiring structure, maintains substantially a certain value. Therefore, the gate to source voltage of the thin film transistor 10 is also maintained substantially at a certain value, and predetermined current flows to the organic LED 12 at the light emitting phase, so as to emit light with predetermined brightness. This light emitting phase is sequentially performed with respect to the pixel circuits 1 arranged in a plurality of numbers, and as a result, the organic LED 12 emits light with desired brightness for each pixel circuit, to display an image in a predetermined pattern.

Figure 2B:
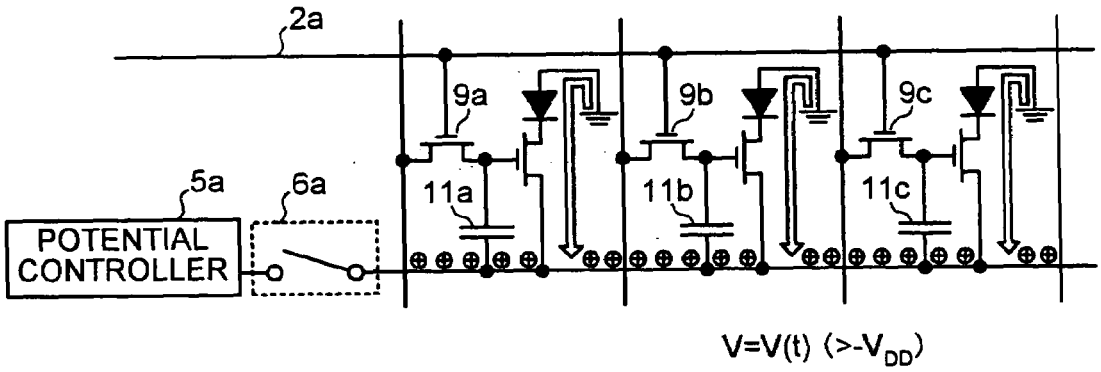

The potential changing phase of changing the potential of the wiring structure 4 will be explained next. FIG. 2B is a schematic diagram for explaining the potential changing phase. At first, the switching unit 6 becomes the OFF state, the wiring structure 4 and the potential controller 5 are electrically insulated from each other, and the wiring structure 4 becomes the floating state.

Since the voltage written at the light emitting phase remains in the capacitor 11, a predetermined gate to source voltage is applied to the thin film transistor 10, so that the thin film transistor 10 maintains the ON state. Therefore, the current flows to the organic LED 12 in the forward direction as at the light emitting phase, and the current flows in the wiring structure 4, passing through the thin film transistor 10.

Figure 3:
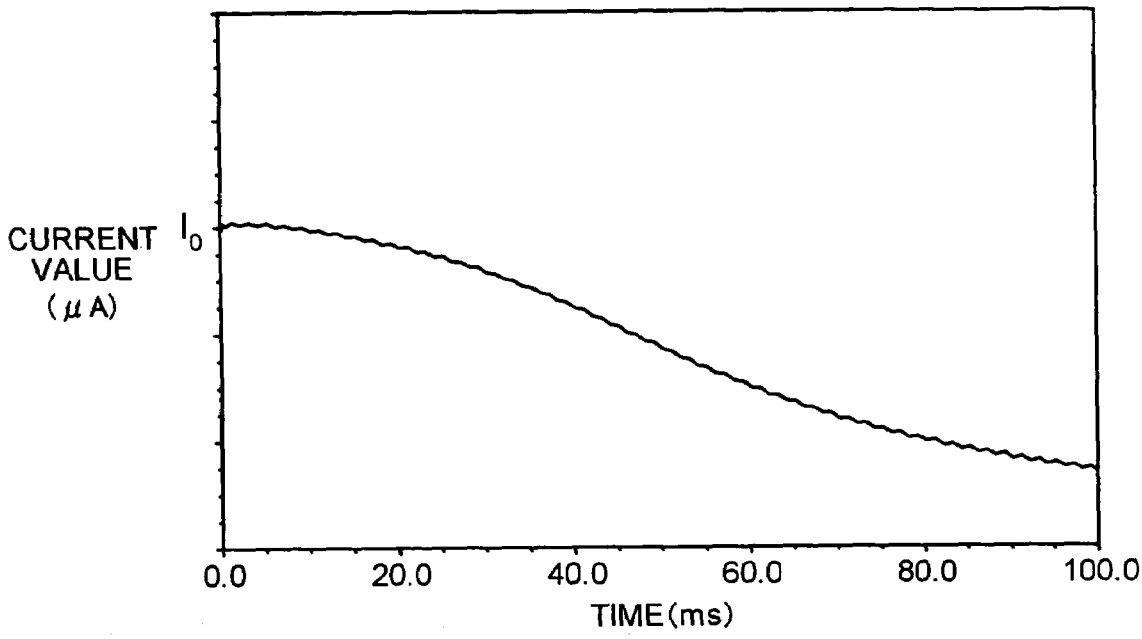
FIG. 3 is a graph of a time fluctuation of a current flowing through an organic LED and flowing through a wiring structure.

FIG. 3 is a graph of the time fluctuation in the current value flowing into the wiring structure 4, passing through the thin film transistor 10, after having started the potential changing phase. In the graph in FIG. 3, the current value flowing in the organic LED 12 at the light emitting phase is designated as $I_0$. As shown in FIG. 3, even after the light emitting phase finishes and control proceeds to the potential changing phase, the current of a predetermined amount passes through the organic LED 12, and flows into the wiring structure 4.

When the switching unit 6 becomes the OFF state, the wiring structure 4 becomes the floating state, and the potential V of the wiring structure 4 gradually increases from the value of $-V_{DD}$ at the light emitting phase, resulting from the inflow current. Here, as shown in FIGS. 1, 2A and 2B, since the wiring structure 4 is electrically connected to the thin film transistors 10 included in the pixel circuits 1 belonging to the same line, the current is supplied from the pixel circuits 1 belonging to the same line to the wiring structure 4.

Actually, the current flows into the wiring structure 4 up to the point when the gate to source voltage of the thin film transistor 10 becomes equal to or below the threshold voltage, and the potential of the wiring structure 4 can rise up to that point. However, since the inflow current value gradually decreases, in the embodiment, the switching unit 6 is again turned to the ON state when the potential of the wiring structure becomes $-(1/2)\,V_{DD}$, to switch to the potential control by the potential controller 5.

After the switching unit 6 is turned on, the potential of the wiring structure 4 changes to a desired value based on the current supplied from the potential controller 5, as well as the current having passed through the organic LED 12 and the thin film transistor 10. Thus, the potential changing phase finishes.

In the image display apparatus according to the embodiment, when the potential of the wiring structure 4 electrically connected to the source electrode of the thin film transistor 10 serving as the driver element is changed, the action by the current passing through the organic LED 12 and flowing into the wiring structure 4 is used. The advantage by having such a configuration will be explained.

Since the wiring structure 4 is electrically connected to the pixel circuits 1 belonging to the same line, the wiring structure 4 has a structure extending in the lateral direction of the display screen, and the physical length thereof becomes very large. Therefore, the wiring structure 4 has to intersect other wiring structures such as data lines 3 three-dimensionally, and hence a certain parasitic capacitance occurs between these intersecting wiring structures. Further, the wiring structure 4 is electrically connected to the capacitors 11 arranged in the respective pixel circuits 1, and the capacity by the capacitor 11 also exists. Hence, the wiring structure 4 has a parasitic capacitance of about 5000 Pico farads, and due to the existence of the parasitic capacitance, it is necessary to supply an electric charge of a predetermined amount to the wiring structure 4, in order to change the potential.

Therefore, when the configuration is such that the electric charge is supplied to the wiring structure 4 only from the potential controller 5 for changing the potential, there are problems in that long time is required, and the load on the potential controller 5 due to the charge supply is large, thereby causing heat generation in the potential controller 5. On the other hand, in the embodiment, since a part of the electric charge supplied for changing the potential is supplied by the current passing through the organic LED 12, the amount of electric charge supplied from the potential controller 5 can be reduced. Specifically, for example, when 50% of the required electric charge is supplied by the current passing through the thin film transistor 10, the power consumption of the potential controller 5 at the potential changing phase can be reduced by 50%, and the heat output can be reduced by 50% than that in the conventional image display apparatus.

Figure 4:
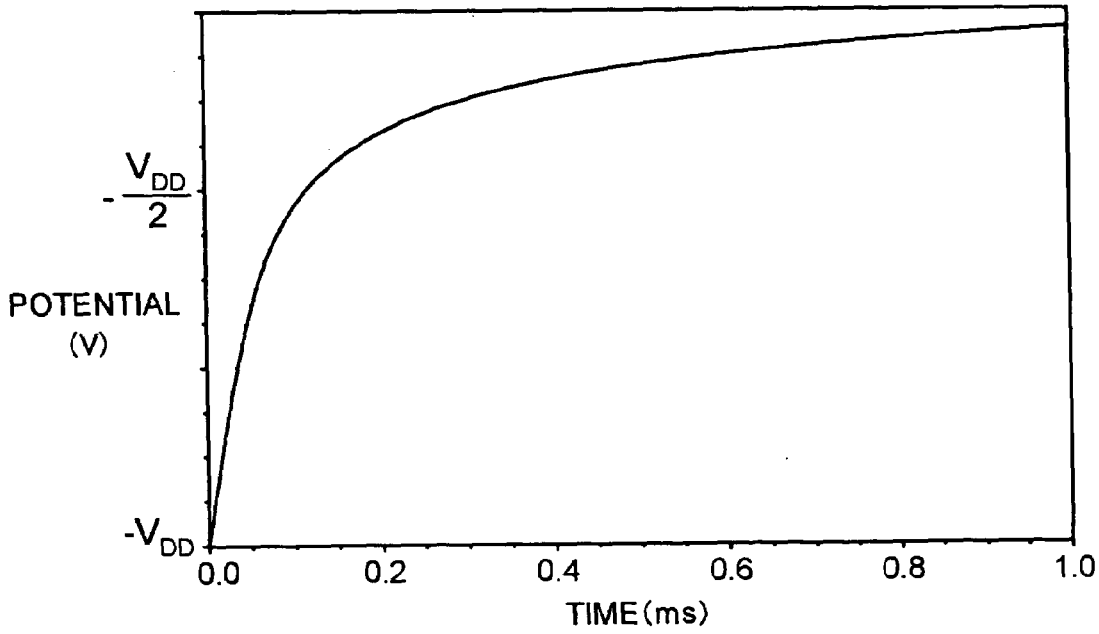
FIG. 4 is a graph of a time fluctuation of a potential of the wiring structure.

FIG. 4 is a graph of the result of numerical calculation for time fluctuation in the potential of the wiring structure 4 resulting from the current passing through the thin film transistor 10 and flowing therein at the potential changing phase. As shown in FIG. 4, the potential of the wiring structure 4 rapidly increases immediately after starting the potential changing phase, and increases by about 50 percent during 0.1 millisecond since starting the potential changing phase. When the potential of the wiring structure 4, which can be realized at the potential changing phase, is for example 0 volt, 50% of the required electric charge can be supplied during 0.1 millisecond.

Since the potential change can be performed in short time by the current passing through the thin film transistor 10, there is an advantage in that deterioration in the display image can be suppressed. In other words, the current flowing into the wiring structure 4 is the current having passed through the organic LED 12, and hence the organic LED 12 emits light with predetermined brightness, while the current flows into the wiring structure 4. On the other hand, in the image display apparatus using the organic LEDs 12, it is preferred to perform black display over a certain period of time while displaying different images, particularly, in order to improve the visibility at the time of displaying motion pictures. Specifically, for example, it is preferable that the organic LEDs 12 are allowed to emit light with desired brightness to perform actual image display, during 8 millisecond, which is half the time (about 16 millisecond) allowed for one frame, and during the remaining 8 millisecond, light emission by the organic LEDs 12 is suspended to perform black display.

Therefore, at the time of potential changing phase performed separately from the light emitting phase, if the organic LEDs 12 emit light over a long period of time, the time for the black display decreases, thereby deteriorating the image quality. On the other hand, in the embodiment, the time while the organic LEDs 12 emit light at the potential changing phase can be suppressed to the time as short as about 0.1 millisecond, in the example shown in FIG. 4. As a result, the influence on the time for performing black display can be substantially ignored, thereby enabling to maintain the high-quality image display characteristic.

As shown in FIG. 3, at the potential changing phase, the current value flowing in the thin film transistor 10, that is, the organic LEDs 12, does not completely agree with the value at the light emitting phase, but gradually decreases with the lapse of time. Therefore, the brightness of the organic LEDs 12 at the potential changing phase becomes different from that at the light emitting phase, and when the organic LEDs 12 emit light over a long period of time, an image is displayed on the screen, which is different from the image to be displayed. However, in the image display apparatus according to the embodiment, since the time while the organic LEDs 12 emit light is restricted to about 0.1 millisecond at the potential changing phase, as shown in FIG. 4, such a light emitting state is not visible to users. Therefore, in the image display apparatus according to the embodiment, deterioration in the image quality can be suppressed.

In the image display apparatus according to the embodiment, since the current is supplied to the wiring structures 4 via the organic LEDs 12, at the potential changing phase, there is an advantage in that there is no need to newly provide a current source or the like. That is, at the point in time when the light emitting phase finishes, the voltage written in the capacitor 11 maintains substantially the same value as at the light emitting phase, and a voltage in the forward direction is applied to the organic LEDs 12. Therefore, when control proceeds to the potential changing phase, as shown in FIG. 3, the state in which the current flows between the source and the drain of the thin film transistor 10 is maintained, as at the light emitting phase. Therefore, at the potential changing phase, a special circuit or the like is not required for supplying the current to the wiring structure 4 via the thin film transistor 10, and the conventional configuration can be directly used therefor.

In the image display apparatus according to the embodiment, the potential of the wiring structure 4 is not controlled only by the current flowing into the wiring structure 4 via the thin film transistor 10, but after predetermined time has passed since control shifts to the potential changing phase, the switching unit 6 is turned again to the ON state, so as to control the potential of the wiring structure 4 by the potential controller 5. The advantage obtained by using the operation of the potential controller 5 together, at the time of changing the potential of the wiring structure 4, will be explained below.

The value of the current flowing into the wiring structure 4 via the thin film transistor 10 is determined by the gate to source voltage of the thin film transistor 10. Here, since the source electrode of the thin film transistor 10 and one of the electrodes of the capacitor 11 are electrically connected to the wiring structure 4, as the potential of the wiring structure 4 increases, the gate to source voltage of the thin film transistor 10 decreases, and hence the value of the current flowing between the source and the drain decreases. Therefore, if it is tried to change the potential of the wiring structure 4 only by the current passing through the thin film transistor 10, there are problems in that the wiring structure 4 may not be able to reach the desired potential due to a decrease in the current value, and a lot of time is required until the wiring structure 4 reaches the desired potential.

Since the value of the gate to source voltage of the thin film transistor 10 is determined corresponding to the brightness of the organic LEDs 12 at the light emitting phase, the value is different for each pixel circuit 1, and even in the same pixel circuit, different for each frame. Therefore, the current flowing into the wiring structure 4 at the start of the potential changing phase differs for each pixel circuit or for each frame, and hence the fluctuation value of the potential of the wiring structure 4 due to the inflow current is different. Therefore, it is difficult to change the potential of the wiring structure 4 to a desired value, only by the current passing through the thin film transistor 10, and a unit that adjusts the difference or the like in the current value passing through the thin film transistor 10 is required.

Therefore, the image display apparatus according to the embodiment adopts a configuration in which the potential controller 5 is used, so that the potential change by the current flowing in via the organic LED 12, and the potential change by the potential controller 5 are performed together. By having such a configuration, a difference or the like in the current flowing in the organic LED 12 can be supplemented, to change the potential of the wiring structure 4. Even when the potential controller 5 is used in the image display apparatus according to the embodiment, the drive load can be reduced and the heat output can be reduced, as compared with the conventional image display apparatus.

Figure 5:
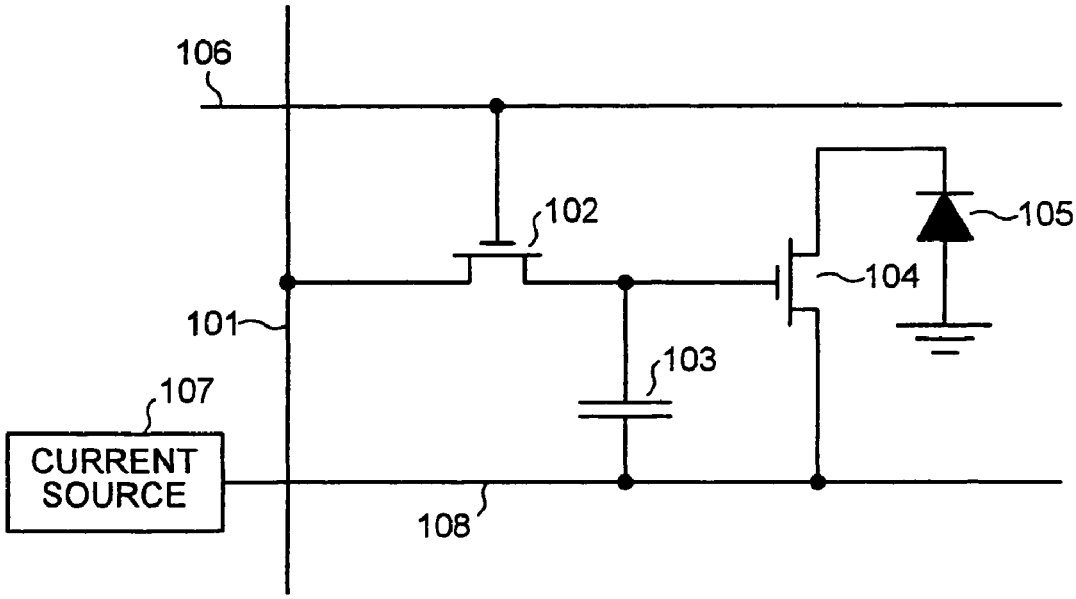
FIG. 5 is a circuit diagram of the configuration of the image display apparatus according to the conventional art.

The image display apparatus of the present invention has been explained according to the embodiment, but the present invention is not limited to the embodiment, and those skilled in the art will be able to consider various examples and modified examples based on the embodiment. For example, the configuration of the pixel circuits constituting the image display apparatus is not limited to the one shown in FIG. 1, and for example, as shown in FIG. 5 depicting an application example, the anode electrode of the organic LED 12 may be connected to the source electrode of the thin film transistor 10. The place for arranging the wiring structure 4 is not limited to the one located on the downstream of the pixel circuit 1 with regard to the current flowing direction, and for example, may be arranged on the upstream of the pixel circuit 1.

As an example of the current-controlled light emitting diode, the organic LED is used in the embodiment, but an inorganic LED may be used. It is not necessary that the current-controlled light emitting diode is electrically equivalent to the light emitting diode, and the current-controlled light emitting diode may emit light even when the current flows in either the forward direction or the reverse direction. When such a current-controlled light emitting diode is used, not only the current can be made to flow into the wiring structure 4, passing through the thin film transistor 10, but also the current can be made to flow out from the wiring structure 4 to the thin film transistor 10, and hence there is an advantage in that the fluctuation margin of the potential can be expanded.

In the embodiment, the switching unit 6 has a configuration such that the wiring structure 4 and the potential controller 5 are insulated from each other, but the configuration may be such that the electrical resistivity in these is changed. Even when the wiring structure 4 and the potential controller 5 are not completely insulated from each other, the electric charge can be accumulated in the wiring structure 4 at a certain rate, by making the current difficult to flow from the wiring structure 4 to the potential controller 5. By the accumulation of the electric charge, the potential of the wiring structure 4 can be changed.

According to the present invention, since the potential change assisting unit assists the potential change of the wiring structure, the load on the potential controller at the time of changing the potential of the wiring structure can be reduced, and the power consumption of the potential controller and the heat generated by the potential controller can be also reduced.

According to the present invention, since the current passing through the current-controlled light emitting diode is used at the time of changing the potential of the wiring structure, potential change can be performed without newly providing a driving circuit or the like.

Although the invention has been described with respect to a specific embodiment for a complete and clear disclosure, the appended claims are not to be thus limited but are to be construed as embodying all modifications and alternative constructions that may occur to one skilled in the art which fairly fall within the basic teaching herein set forth.

What is claimed is:

1. An image display apparatus comprising:

a current-controlled light emitting diode emitting light with brightness corresponding to a current flowing therethrough;

a wiring structure electrically connected to the current-controlled light emitting diode;

a potential controller controlling a potential of the wiring structure; and a potential change assisting unit controlling electric conductivity between the potential controller and the wiring structure, to electrically insulate the potential controller from the wiring structure after a light emitting phase, wherein the light emitting diode emits light while the potential change assisting unit electrically insulates the potential controller.

2. The image display apparatus according to claim 1, wherein when the potential controller is electrically insulated from the wire structure the potential of the wiring structure changes based on the current flowing through the current-controlled light emitting diode.

3. The image display apparatus according to claim 1, wherein the potential change assisting unit electrically connects the potential controller and the wiring structure again after a predetermined time passes since the potential controller and the wiring structure are electrically insulated; and the potential controller finely adjusts the potential of the wiring structure after having been electrically connected to the wiring structure again.

4. The image display apparatus according to claim 1, further comprising:

a driver element controlling the current flowing through the current-controlled light emitting diode based on an applied voltage;

a data line configured to supply a voltage to be applied to the driver element;

a switching element controlling a timing of voltage supply by the data line; and a scan line configured to control a driven state of the switching element.

5. The image display apparatus according to claim 1, wherein the potential controller controls the potential of the wiring structure so that a predetermined voltage is supplied between an anode and a cathode of the current-controlled light emitting diode during the light emitting phase.

6. The image display apparatus according to claim 1, wherein a cathode of the current-controlled light emitting diode is electrically connected to the wiring structure, and an anode of the current-controlled light emitting diode is connected to a ground wire, and the potential controller controls the potential of the wiring structure so that the wiring structure has a negative potential during the light emitting phase.

7. The image display apparatus according to claim 1, wherein the current-controlled light emitting diode includes an organic light emitting diode.

8. The image display apparatus according to claim 1, wherein a time period when the light emitting diode emits light while the potential change assisting unit electrically insulates between the potential controller and the wiring structure is not more than about 0.1 milliseconds.

9. The image display apparatus according to claim 1, wherein the potential change assisting unit includes a transistor serving as a switch.

10. An image display apparatus comprising:

a light emitting diode;

a conductive pattern electrically connected to the light emitting diode; and a switching element controlling a supply of a predetermined potential to the conductive pattern therethrough, wherein the light emitting diode emits light for a time period while the predetermined potential is not supplied to the conductive pattern through the switching element.

11. The image display apparatus according to claim 10, wherein the time period when the light emitting diode emits light while the predetermined potential from outside is not supplied to the conductive pattern is not more than about 0.1 milliseconds.

12. The image display apparatus according to claim 10, wherein a cathode of the light emitting diode is electrically connected to the conductive pattern supplied with the predetermined potential, and an anode of the light emitting diode is electrically connected to another conductive pattern supplied with another potential higher than the predetermined potential.

13. The image display apparatus according to claim 10, wherein the switching element includes a transistor serving as a switch.

14. The image display apparatus according to claim 10, wherein the light emitting diode includes an organic light emitting diode.

15. A method of controlling an image display apparatus comprising:

providing the image display apparatus having a light emitting diode, a conductive pattern electrically connected to the light emitting diode, and a potential controller electrically connected to the conductive pattern through a switching element;

turning on the switching element to supply a first potential from the potential controller to the conductive pattern so that the light emitting diode emits light; and turning off the switching element to stop supplying the first potential from the potential controller to the conductive pattern;

turning on the switching element to supply a second potential from the potential controller to the conductive pattern while the light emitting diode emits light, so that the light emitting diode stops emitting light, wherein the light emitting diode emits light while the switching element is turned off.

16. The method according to claim 15, wherein a time period when the light emitting diode emits light while the switching element is off, is not more than about 0.1 milliseconds.

17. The method according to claim 15, wherein a cathode of the light emitting diode is electrically connected to the conductive pattern, and an anode of the light emitting diode is electrically connected to another conductive pattern supplied with another potential higher than the predetermined potential with the switching element being on.

18. The method according to claim 15, wherein the switching element includes a transistor serving as a switch.

19. The method according to claim 15, wherein the light emitting diode includes an organic light emitting diode.

* * * * *